US009199254B2

(12) United States Patent
Zhou et al.

(10) Patent No.: US 9,199,254 B2
(45) Date of Patent: Dec. 1, 2015

(54) ROCKER SWITCH SHOWER

(75) Inventors: Huasong Zhou, Xiamen (CN); Hongliang Ma, Xiamen (CN); Zhongcheng Jin, Xiamen (CN); Boqing Lian, Xiamen (CN)

(73) Assignees: Huasong Zhou, Fujian (CN); XIAMEN SOLEX HIGH-TECH INDUSTRIES CO., LTD., Xiamen, Fujian (CN)

( * ) Notice: Subject to any disclaimer, the term of this patent is extended or adjusted under 35 U.S.C. 154(b) by 220 days.

(21) Appl. No.: 13/991,036

(22) PCT Filed: Oct. 11, 2011

(86) PCT No.: PCT/CN2011/080629

§ 371 (c)(1),
(2), (4) Date: May 31, 2013

(87) PCT Pub. No.: WO2012/075852

PCT Pub. Date: Jun. 14, 2012

(65) Prior Publication Data

US 2013/0247294 A1 Sep. 26, 2013

(30) Foreign Application Priority Data

Dec. 6, 2010 (CN) ..... 2010 1 0575456

(51) Int. Cl.
*B05B 1/18* (2006.01)
*B05B 1/16* (2006.01)

(52) U.S. Cl.
CPC ..... *B05B 1/185* (2013.01); *B05B 1/1636* (2013.01); *B05B 1/18* (2013.01)

(58) Field of Classification Search
CPC ..... B05B 1/1627; B05B 1/1636; B05B 1/18; B05B 1/185; B05B 1/1663
USPC ..... 4/615; 239/443–449
See application file for complete search history.

(56) References Cited

U.S. PATENT DOCUMENTS

2008/0017735 A1* 1/2008 Zhou ..... 239/437

FOREIGN PATENT DOCUMENTS

| | | | |
|---|---|---|---|
| CN | 101069877 | A | 11/2007 |
| CN | 201026470 | Y | 2/2008 |
| CN | 101428259 | A | 5/2009 |
| CN | 201558755 | U | 8/2010 |
| CN | 101832407 | A | 9/2010 |
| CN | 101844117 | A | 9/2010 |
| CN | 102059179 | A | 5/2011 |

* cited by examiner

*Primary Examiner* — J. Casimer Jacyna
(74) *Attorney, Agent, or Firm* — Rabin & Berdo, PC

(57) ABSTRACT

A rocker switch shower has a handle, an outlet part, a control part and an operation part. The handle has a handheld part and a connect part. An inlet hole is arranged in the handheld part, and a mounting cavity communicated with the inlet hole is arranged in the connect part. The outlet part is mounted to the connect part and corresponding to the mounting cavity, being provided with a plurality of outlet functions. The control part is mounted in the mounting cavity and comprises a fixed plate and a movable plate, a plurality of water division holes are arranged in the fixed plate. The control part comprises a control shaft and a rocker, the control shaft is connected in the handle in a moving manner and with the movable plate in a transmitting manner, and the inner end of the rocker is connected to the control shaft.

17 Claims, 7 Drawing Sheets

ROCKER SWITCH SHOWER

FIELD OF THE INVENTION

The present invention relates to a rocker switch shower.

BACKGROUND OF THE INVENTION

The switch shower at the prior art, such as the rotary switch shower, comprises a handle, an outlet part, a switch part and an operation part. The handle is provided with a handheld part and a connect part, an inlet hole is arranged in the handheld part, a mounting cavity communicated with the inlet hole is arranged in the connect part. The outlet part is mounted to the connect part and is corresponding to the mounting cavity, which is provided with a plurality of outlet functions. The control part is mounted in the mounting cavity and comprises a fixed plate and a movable plate, a plurality of water division holes of which the number is equal to that of the outlet functions are arranged to the fixed plate, and the water division holes and the outlet functions are corresponding to each other respectively, at least the outlet functions switch can be achieved through the relative movement of the fixed plate and the movable plate. The operation part comprises a knob that is arranged to the outlet part, the movable plate can be driven to rotate with respect to the fixed plate through the knob. Because the knob is arranged to the outlet part, the users have to use one hand to hold the handheld part, and to use another hand to rotate the knob during switch process, both hands are needed simultaneously, and the switch is inconvenient.

SUMMARY OF THE INVENTION

The object of the present invention is to offer rocker switch shower which overcomes the defects of inconvenient switch of the switch shower at the prior art.

The technical proposal solving the technical matter in the present invention is:

Rocker switch shower, comprises:

A handle (100), which is provided with a handheld part (110) and a connect part (120), and an inlet hole (111) is arranged in the handheld part (110), and a mounting cavity (121) communicated with the inlet hole (111) is arranged in the connect part (120);

An outlet part (200), which is mounted in the connect part (120) and corresponding to the mounting cavity (121), and is provided with a plurality of outlet functions;

A control part (300), which is mounted in the mounting cavity (121) and comprises a fixed plate (310) and a movable plate (320), a plurality of water division holes (311) of which the number is equal to that of the outlet functions are arranged to the fixed plate (310), and the water division holes (311) and the outlet functions are communicated with each other correspondingly and respectively, the relative movement of the fixed plate (310) and the movable plate (320) can achieve the outlet functions switch at least; and An operation part (400), which comprises a control shaft (410) and a rocker (420), the control shaft (410) is connected in the handle (100) in a moving manner and to the movable plate (320) in a transmitting manner, the inner end of the rocker (420) is connected to the control shaft (410), and the outer end extends out of the handheld part (110) for user's control, and then the control shaft (410) is driven to move through the relative movement of the rocker (420) to the handheld part (110), and the movable plate (320) is driven to move with respect to the fixed plate (310) through the movement of the control shaft (410).

In a preferred embodiment, an outlet waterway (321) is arranged in the movable plate (320), which is communicated with the mounting cavity (121), and the communication between the water division holes (311) and the outlet waterway (321) can be at least switched through the relative movement of the movable plate (320) and the fixed plate (310).

In a preferred embodiment, the control shaft (410) can rotate and be connected in the handle (100) in a sliding manner, the rotation of the movable plate (320) can be driven through the rotation of the control shaft (410), the switch of the water division holes (311) can be achieved through the relative rotation between the movable plate (320) and the fixed plate (310), the sliding of the movable plate (320) can be driven through the sliding of the control shaft (410), and the flow regulation can be achieved through the relative sliding of the movable plate (320) and the fixed plate (310).

In a preferred embodiment, the control part (300) also comprises a fixed seat (330), the fixed seat (330) is provided with a water passage (332) and a plurality of outlet holes (331) of which the number is equal to that of the water division holes (311), the water division holes (311), the outlet holes (331) and the outlet functions are communicated correspondingly and respectively;

The fixed plate is also provided with a penetrating hole (312) penetrating from front to back, and the fixed plate (310) is fixed to the fixed seat (330) hermetically, and the outer end opening of the water passage (332) is communicated with the mounting cavity (121), and the inner end opening is communicated with the penetrating hole (312);

The outlet waterway (321) of the movable plate (320) is a groove arranged at the back, the back side of the movable plate (320) is relied on the front side of the fixed plate (310) hermetically, and the groove is provided with a communicating part and a switch part, and the communicating part is always communicated with the penetrating hole (312), at least one water division hole (311) can be chosen to be communicated by the switch part.

In a preferred embodiment, two water division holes (311) are arranged eccentrically and provided with the same distance to the rotary shaft of the movable plate (320); the farther is the switch part of the groove to the rotary shaft of the movable plate (320), the bigger is the central angle.

In a preferred embodiment, the operation part (400) also comprises a first gear (440) and a second gear (450), the first gear (440) is fixed to the inner end of the control shaft (410), the second gear (450) is connected to the movable plate (320) in a rotating manner synchronously and coaxially, and the first gear (440) is meshed with the second gear (450), In a preferred embodiment, the first gear (440) is meshed with the second gear (450), and then a bevel gears mechanism is generated with vertical transmission.

In a preferred embodiment, a locating mechanism is arranged between the top end of the second gear (450) and the mounting cavity (121), which comprises a locating pin (461), a against spring (462) connecting the locating pin (461) with the second gear (450) and a plurality of locating slots (171) opened in the mounting cavity (121), the locating pin (461) is coupling with the locating slots (171).

In a preferred embodiment, the operation part (400) also comprises a gear support (430) which is arranged in the mounting cavity (121) in a sliding manner, and the second gear (450) can be connected to the gear support (430) in a rotating manner.

Compared with the technical proposal at the prior, the benefits of the present invention are:

1 the control shaft is driven to move through the relative movement of the rocker and the handheld part, and then the movable plate is driven to move with respect to the fixed plate, and then at least the switch function can be achieved, and it overcomes the defects at the prior art, the effect generated are: a, the users can use one hand to hold the handheld part during switch process, and the finger of that hand can also control the movement of the rocker simultaneously, therefore switch can be achieved by one hand, and it is convenient and fast; b, the control part is arranged in the mounting cavity, so that the occupation of the space in the handheld part is not increased;

2 the switch of the water division holes is achieved through the relative movement of the movable plate and the fixed plate, and then the flow regulation is achieved through the relative sliding of the movable plate and the fixed plate, so that the present invention not only is provided with a switch function, but also a flow regulation function.

3 water flows through the inlet hole, the mounting cavity, the water passage, the penetrating hole, the outlet waterway and the water division hole in turns with reasonable arrangement and low space occupation;

4 the first gear is meshed to the second gear to form a bevel gear mechanism with reasonable arrangement and simple structure;

5 a locating mechanism is arranged between the top end of the second gear and the mounting cavity with not only the locating function but also enhanced tight relying force between the fixed plate and the movable plate;

6 the second gear can be connected to the gear support in a transmitting manner with ensured counter axis degree and accurate switch.

BRIEF DESCRIPTION OF THE DRAWINGS

With the following description of the drawings and specific embodiments, the invention shall be further described in details.

DESCRIPTION OF THE PREFERRED EMBODIMENTS

Figure 1:
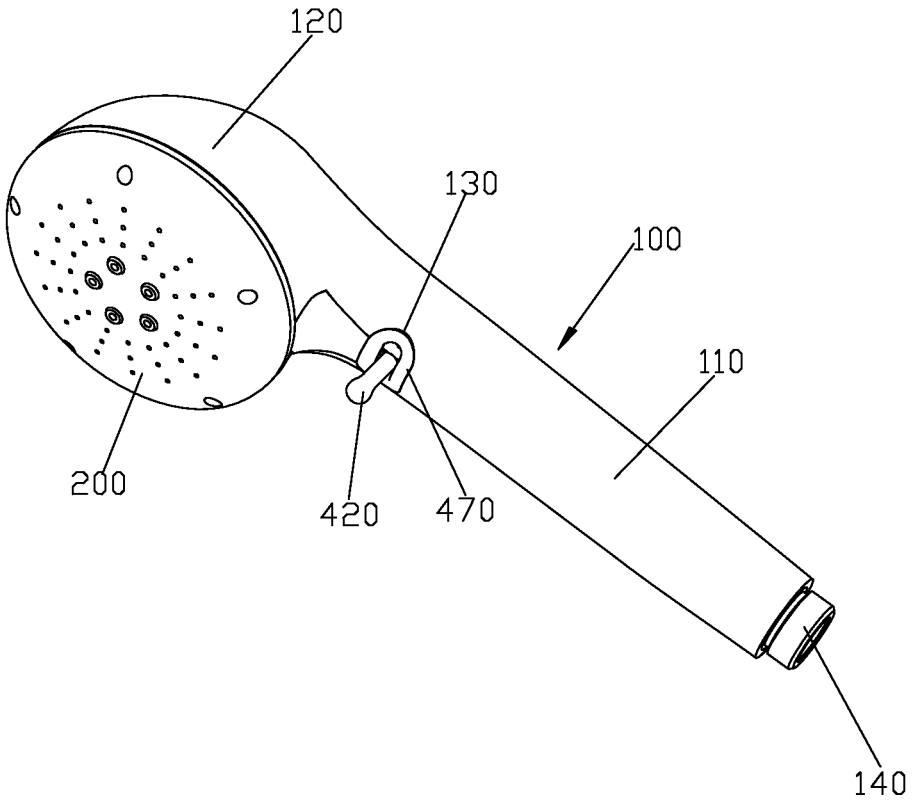
FIG. 1 shows the solid abridged general view of the shower in a preferred embodiment.
Figure 2:
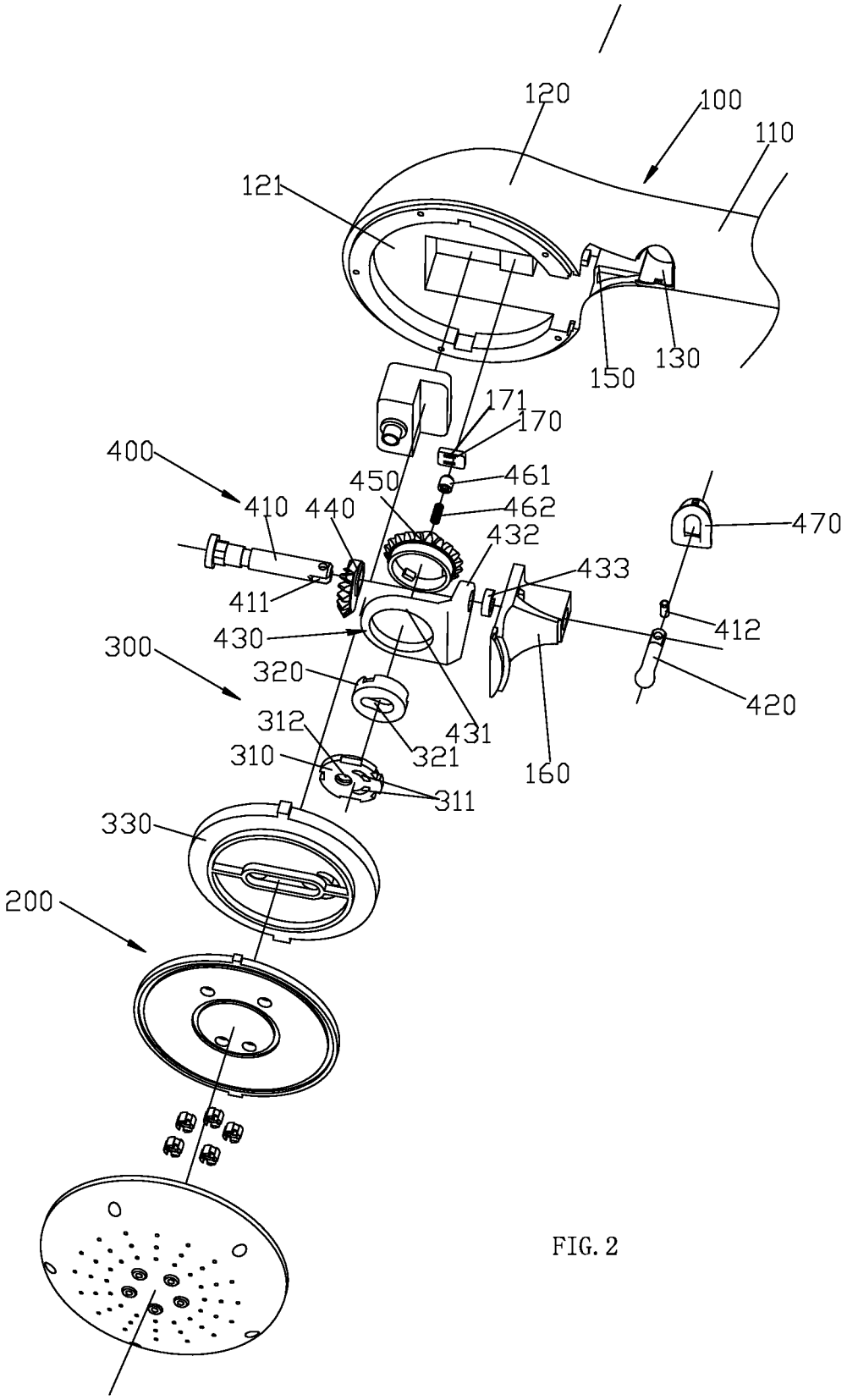
FIG. 2 shows the first solid exploded view of the shower in a preferred embodiment.
Figure 3:
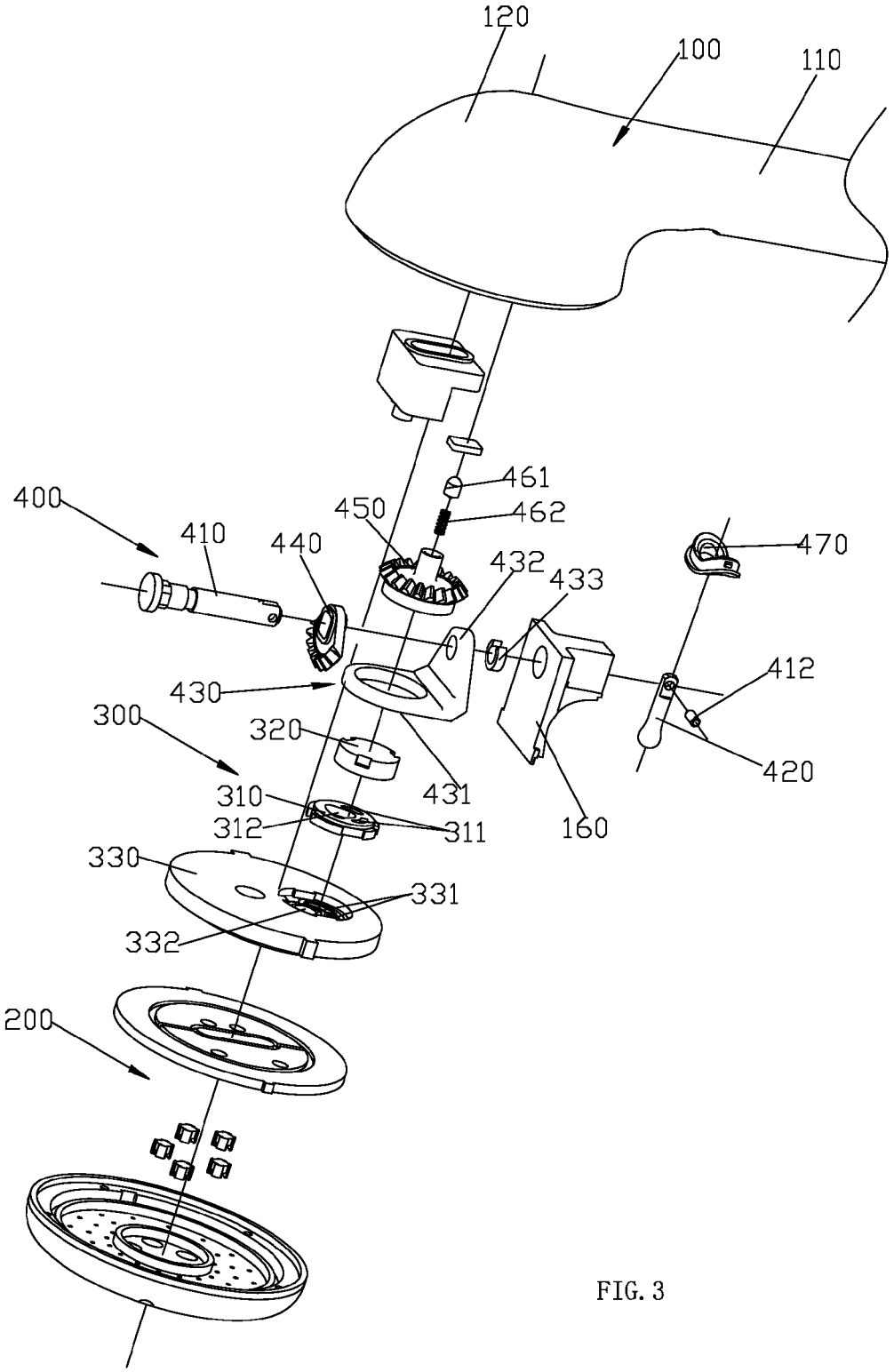
FIG. 3 shows the second solid exploded view of the shower in a preferred embodiment.
Figure 4:
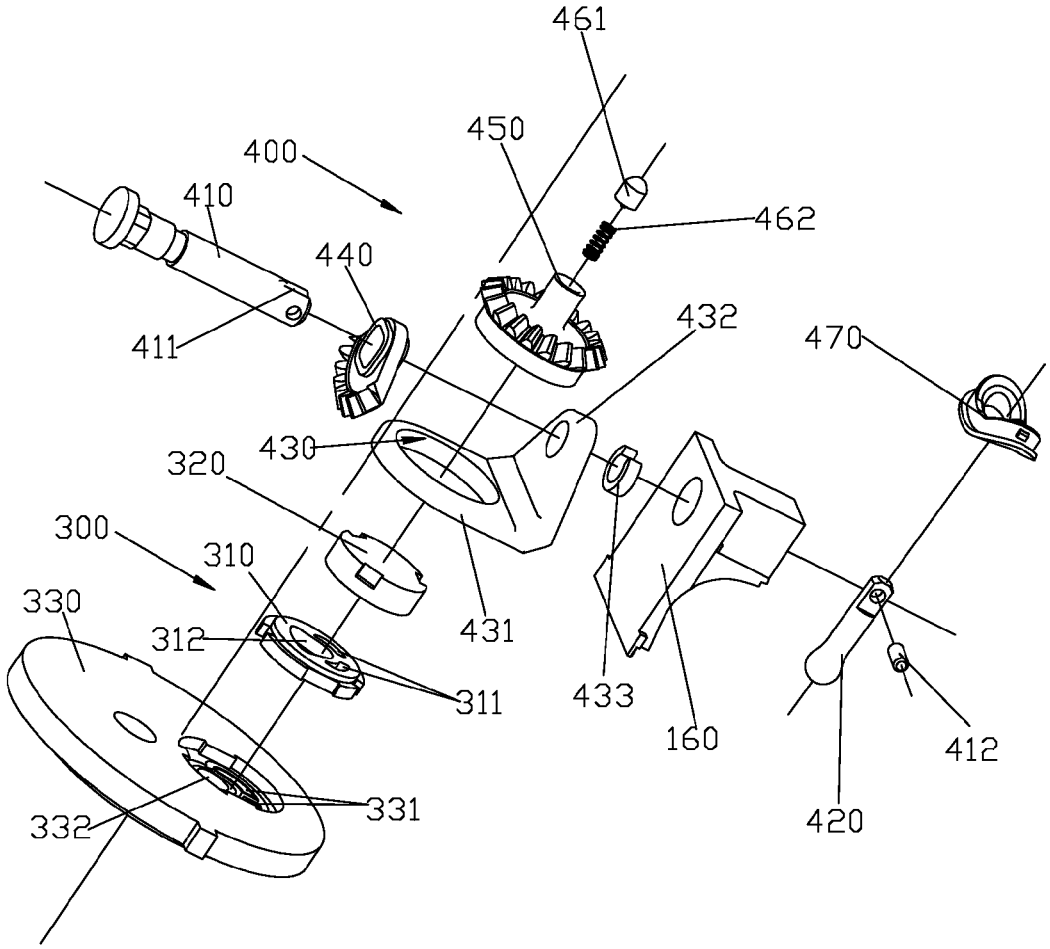
FIG. 4 shows the solid exploded view of the control part and the operation part of the shower in a preferred embodiment.
Figure 5:
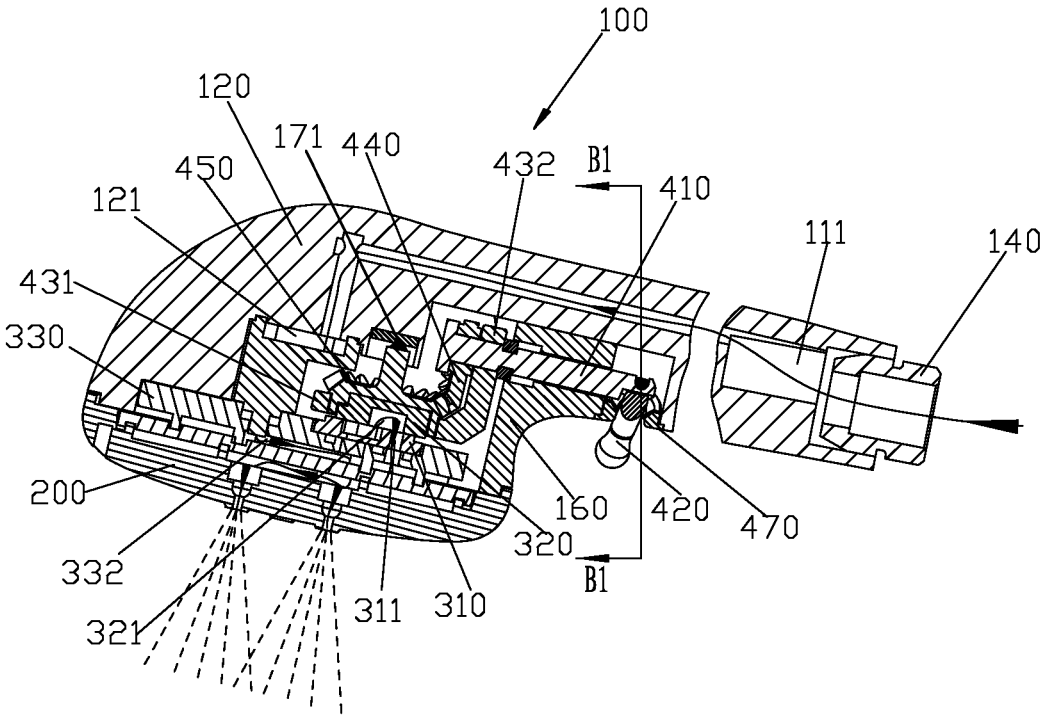
FIG. 5 shows the sectional view of FIG. 6 C1-C1, water coming out according to the first function.
Figure 6:
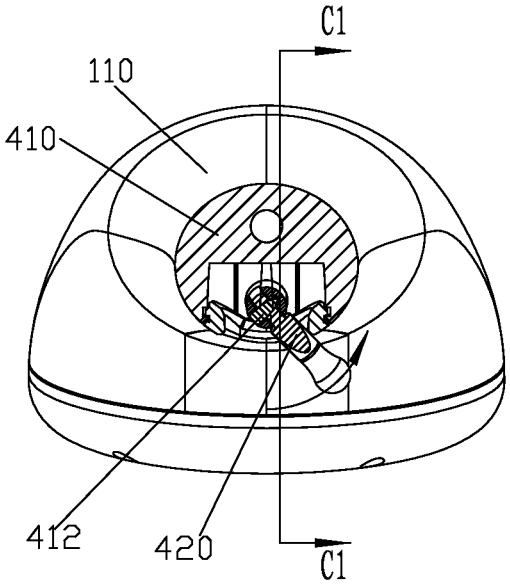
FIG. 6 shows the sectional view of FIG. 5 B1-B1.
Figure 7:
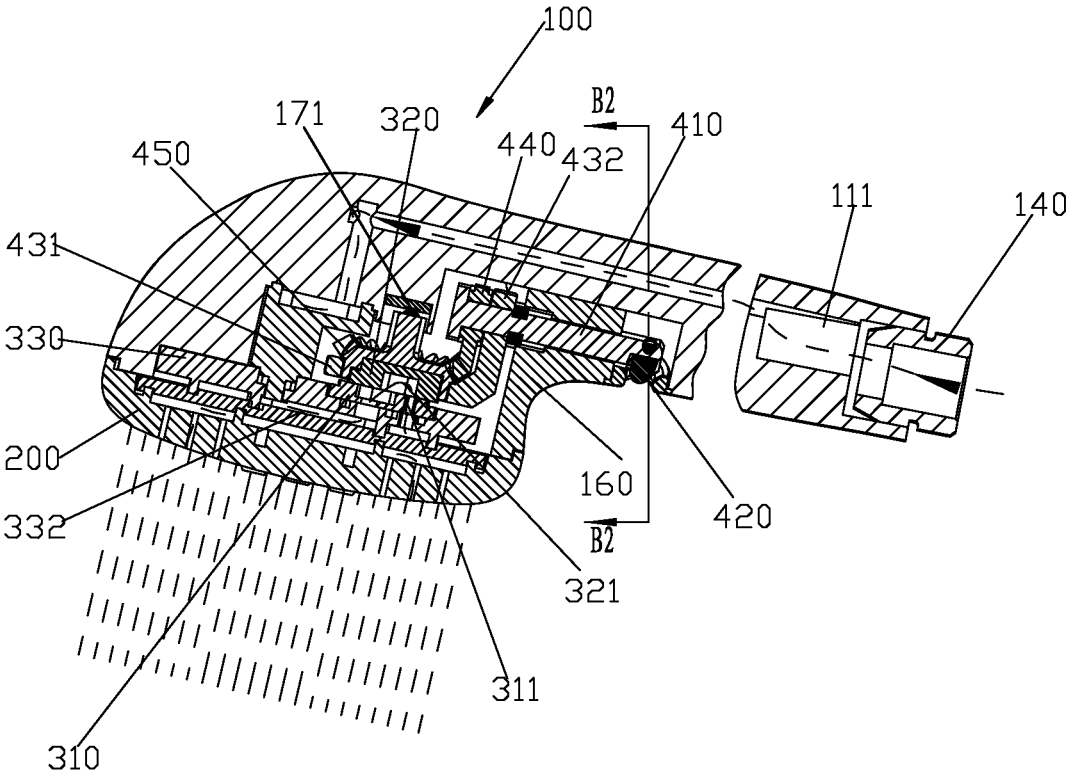
FIG. 7 shows the sectional view of FIG. 8 C2-C2, with water coming out according to the second function.
Figure 8:
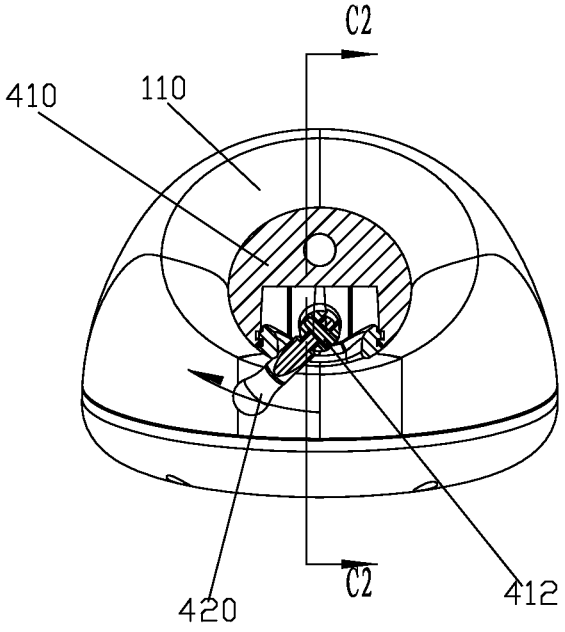
FIG. 8 shows the sectional view of FIG. 7 B2-B2.
Figure 9:
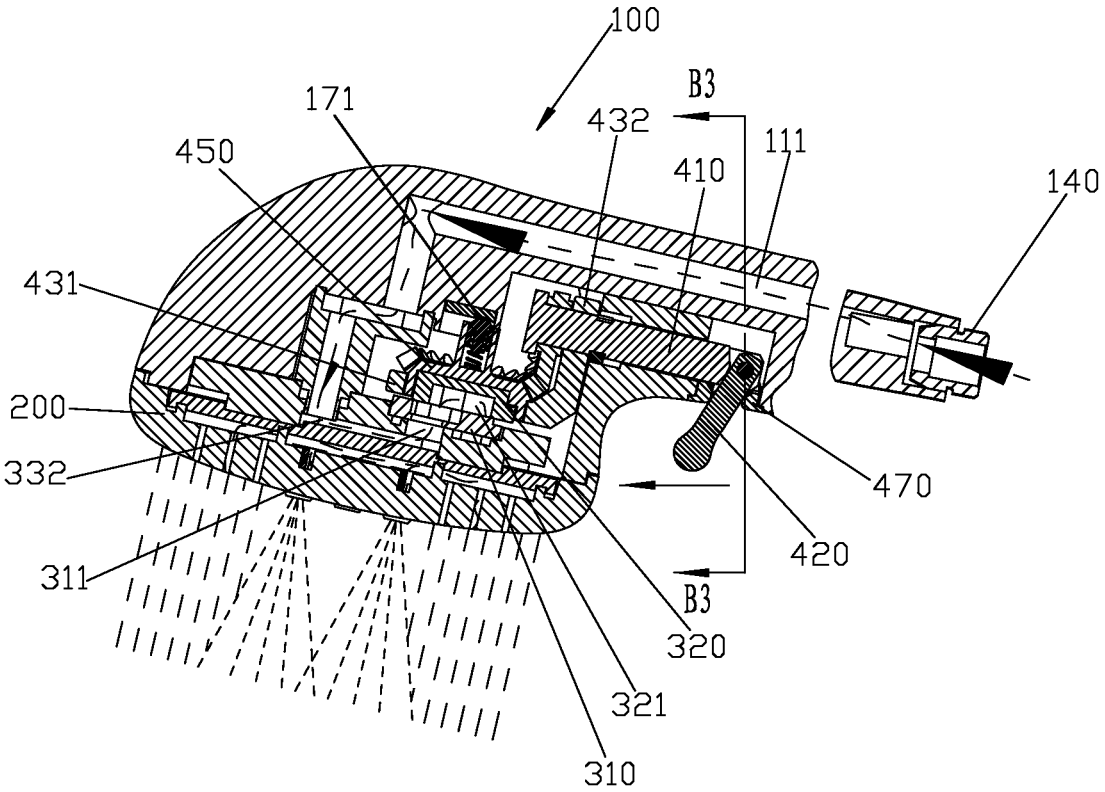
FIG. 9 shows the sectional view of FIG. 10 C3-C3, with water coming out according to the first and second functions.
Figure 10:
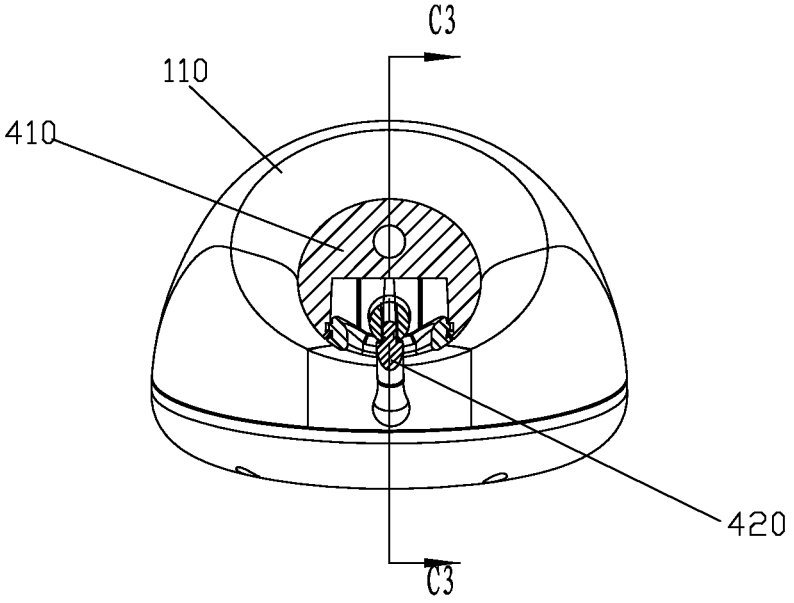
FIG. 10 shows the sectional view of FIG. 9 B3-B3.

According to FIG. 1 to 10, the rocker switch shower comprises a handle 100, an outlet part 200, a control part 300 and a operation part 400.

The handle 100 is provided with a handheld part 110 and a connect part 120 which are formed in one piece, an inlet hole 111 is arranged to in the handheld part 110, a mounting cavity 121 which is communicated with the inlet hole 111 and of which the opening is ahead downward is arranged in the connect part 120. And a mounting hole 130 for the rocker's penetrating is opened on the handheld part 110. And a plug 140 is connected to the end of the handheld part 110.

The outlet part 200 is mounted to the connect part 120 and corresponding to the mounting cavity 121, which is provided with a plurality of outlet functions, there are four outlet functions in the present embodiment, which are the spray water, the shower water, the spray-and-shower-mixed water, and water stop.

The control part 300 is mounted in the mounting cavity 121 and comprises a fixed plate 310, a movable plate 320 and a fixed seat 330. The fixed seat 330 is provided with a water passage 332 and a plurality of outlet holes 331 of which the number is equal to that of the outlet functions. The fixed plate is provided with a penetrating hole 312 penetrating from front to back and a plurality of water division holes 311 of which the number is equal to that of the outlet functions, and the fixed plate 310 is fixed on the fixed seat 330 hermetically, and so that: the outer end opening of the water passage 332 is communicated with the mounting cavity 121, and the inner end opening is communicated with the lower end opening of the penetrating hole 312; the water division holes 311, the outlet holes 331 and the outlet functions are corresponding to each other respectively. An outlet waterway 321 is arranged to the movable plate 320, which is a groove arranged at the back and is provided with a communicating part and a switch part, the back side of the movable plate 320 is relied on the front side of the fixed plate 310 hermetically, and the communicating part is always communicated with the penetrating hole 312, at least one water division hole 311 can be chosen to be communicated by the switch part. In the present embodiment, the two water division holes 311 are arranged eccentrically and provided with the same distance to the rotary shaft of the movable plate 320; the farther is the switch part of the groove to the rotary shaft of the movable plate 320, the bigger is the central angle. In the present embodiment, the fixed plate and the movable plate are made of ceramic.

In the present embodiment, according to FIG. 5 to 10, the movable plate 320 can rotate with respect to the fixed plate 310 and rotate among the first angle, the middle angle and the second angle, the switch of the water division holes 311 is achieved through the relative rotation of the movable plate 320 and the fixed plate 310, and for example, water comes out of the first function at the first angle, and water comes out of the second function at the second angle. The movable plate 320 can slide with respect to the fixed plate 310 and between the first position and the second position, the flow regulation can be achieved through the relative sliding of the movable plate 320 and the fixed plate 310, for example, the movable plate 320 is changed between the first and the second position when the movable plate 320 is at the first angle or the second angle, and then the switch part is intersect with the water division holes with different outlet area; the outlet switch also can be achieved, because the farther is the switch part of the groove to the rotary shaft of the movable plate 320, the bigger is the central angle, when the movable plate 320 is at the middle angle, the switch part and the two water division holes are stagger when at the first position and no water comes out, and the switch part and the two water division holes are intersected when at the second position and mixed water comes out.

The operation part 400 comprises a control shaft 410, a rocker 420, a gear support 430, a first gear 440 and a second gear 450.

The control shaft 410 is connected in the handle 100 in a moving manner, and the inner end of the rocker 420 is connected to the control shaft 410, and the outer end of the rocker 420 penetrates the mounting hole 130 and extends out of the handheld part 110 for user's control, and the rocker 420 can drive the control shaft slide front and back and swing left and right in the present embodiment. In the present embodiment, a fixed cover 470 sleeving to the rocker 410 in a moving manner is connected to the mounting hole 130 in a covering manner, and in the present embodiment, a cutting slot 411 is opened at the outer end of the control shaft 410, and the inner end of the rocker 420 is inserted into the cutting slot 411 in a coupling manner, and a pin roll 412 penetrates the inner end of the rocker 420 and the outer end of the control shaft 410, so that the left-and-right swing of the rocker 420 can drive the left-and-right swing of the control shaft 410, and then the control shaft can be driven to slide backward when the rocker 420 is against the fulcrum of the hole wall (such as the fixed cover 470) of the handheld part 110 and the rotation is forward, and to slide forward when the rotation is backward.

The gear support 430 comprises an annular part 431 and a vertical part 432 that is fixed to the side of the annular part 431 vertically. The gear support 430 can be connected in the mounting cavity 121 in a front-and-back sliding manner, the inner end of the control shaft 410 can penetrate the vertical part 430 in a rotating manner, and a clamping plate 433 connects the vertical part and the control shaft, so that the vertical part cannot slide with respect to the control shaft axially, namely the connection relation between the control shaft 410 and the gear support 430 is that: they can rotate relatively but move axially relatively.

The second gear 450 is connected to the movable plate 320 in a rotating manner synchronously and coaxially. The first gear 440 is fixed to the inner end of the control shaft 410, and the first gear 440 is meshed with the second gear 450, and then a bevel gears mechanism is generated with vertical transmission, so that the first gear can be driven to rotate when the control shaft 410 is rotated, and then the second gear is driven to rotate, and then the movable plate 320 is driven to rotate. The second gear 450 can be connected in the annular part 431 in a rotating manner, so that the gear support, the first gear, the second gear and the movable plate can be driven to slide when the control shaft slides. The first gear 440 can be provided with teeth only around the periphery of the lower part, and the upper part is cambered surface, namely the first gear is a sector gear, which is provided with reduced volume and space saving.

In the present embodiment, a locating mechanism is arranged between the top end of the second gear 450 and the mounting cavity 121, which comprises a locating pin 461, a against spring 462 connecting the locating pin 461 with the second gear 450 and a plurality of locating slots 171 opened in the mounting cavity 121, and the locating pin 461 is coupling with the locating slots 171, and the locating slots 171 are opened on the gear plate 170.

For easy assembly, a slot 150 can be opened at the joint of the connect part and the handheld part, and an overlay 160 covers the slot 150 hermetically.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The handheld part is extended out of the outer end of the rocker switch shower in the present invention, the control shaft is driven to move through the relative movement of the rocker and the handheld part, and then the movable plate is driven to move through the movement of the control shaft, and then at least the outlet functions switch can be achieved through the relative movement of the fixed plate and the movable plate. During the switch process, the user uses one hand to hold the handheld part, and the finger of that hand can control the movement of the rocker simultaneously, therefore the switch can be achieved though one hand, and is convenient and fast.

What is claimed is:

1. Rocker switch shower, comprising:

a handle, which is provided with a handheld part and a connect part, and an inlet hole is arranged in the handheld part, and a mounting cavity communicating with the inlet hole is arranged in the connect part;

an outlet part, which is mounted in the connect part and corresponding to the mounting cavity, and is provided with a plurality of outlet functions;

a control part, which is mounted in the mounting cavity and comprises a fixed plate and a movable plate, a plurality of water division holes of which the number is equal to that of the outlet functions are arranged in the fixed plate, and the water division holes and the outlet functions communicate with each other correspondingly and respectively, relative movement of the fixed plate and the movable plate can achieve the outlet functions switch at least; and an operation part, which comprises a control shaft and a rocker, the control shaft is connected in the handle in a moving manner and to the movable plate in a transmitting manner, the inner end of the rocker is connected to the control shaft, and the outer end extends out of the handheld part for user's control, and then the control shaft is driven to move through the relative movement of the rocker to the handheld part, and the movable plate is driven to move with respect to the fixed plate through the movement of the control shaft, wherein, the control shaft can rotate and be connected in the handle in a sliding manner, the movable plate can be driven to rotate through the rotation of the control shaft, the switch of the water division holes can be achieved through the relative rotation between the movable plate and the fixed plate, the movable plate can be driven to slide through the sliding of the control shaft, and the flow regulation can be achieved through the relative sliding of the movable plate and the fixed plate.

2. Rocker switch shower according to claim 1, wherein, an outlet waterway is arranged in the movable plate, which communicates with the mounting cavity, and the communication between the water division holes and the outlet waterway can be at least switched through the relative movement of the movable plate and the fixed plate.

3. Rocker switch shower according to claim 1, wherein, the control part also comprises a fixed seat, the fixed seat is provided with a water passage and a plurality of outlet holes of which the number is equal to that of the water division holes, the water division holes, the outlet holes and the outlet functions communicate correspondingly and respectively;

the fixed plate is also provided with a penetrating hole penetrating from front to back, and the fixed plate is fixed to the fixed seat hermetically, the outer end opening of the water passage communicates with the mounting cavity, and the inner end opening communicates with the penetrating hole;

the outlet waterway of the movable plate is a groove arranged at the back, the back side of the movable plate is relied on the front side of the fixed plate hermetically, the groove is provided with a communicating part and a switch part, and the communicating part always communicates with the penetrating hole, at least one water division hole can be chosen to communicate with the switch part.

4. Rocker switch shower according to claim 3, wherein, two water division holes are arranged eccentrically and provided with the same distance to the rotary shaft of the movable plate;

the farther is the switch part of the groove to the rotary shaft of the movable plate, and the bigger is the central angle.

5. Rocker switch shower according to claim 3, wherein, the operation part also comprises a first gear and a second gear, the first gear is fixed to the inner end of the control shaft, the second gear is connected to the movable plate in a rotating manner synchronously and coaxially, and the first gear is meshed with the second gear.

6. Rocker switch shower according to claim 5, wherein, the first gear is meshed with the second gear, and then a bevel gears mechanism is generated with vertical transmission.

7. Rocker switch shower according to claim 5, wherein, a locating mechanism is arranged between the top end of the second gear and the mounting cavity, which comprises a locating pin, a against spring connecting the locating pin with the second gear and a plurality of locating slots opened in the mounting cavity, the locating pin is coupling with the locating slots.

8. Rocker switch shower according to claim 5, wherein, the operation part also comprises a gear support which is arranged in the mounting cavity in a sliding manner, and the second gear can be connected to the gear support in a rotating manner.

9. Rocker switch shower according to claim 6, wherein, the first gear can be provided with teeth around the periphery of a lower part only, and an upper part is a cambered surface.

10. Rocker switch shower according to claim 2, wherein, the control shaft can rotate and be connected in the handle in a sliding manner, the rotation of the movable plate can be driven through the rotation of the control shaft, the switch of the water division holes can be achieved through the relative rotation between the movable plate and the fixed plate, the sliding of the movable plate can be driven through the sliding of the control shaft, and the flow regulation can be achieved through the relative sliding of the movable plate and the fixed plate.

11. Rocker switch shower according to claim 10, wherein, the control part also comprises a fixed seat, the fixed seat is provided with a water passage and a plurality of outlet holes of which the number is equal to that of the water division holes, the water division holes, the outlet holes and the outlet functions communicate correspondingly and respectively;

the fixed plate is also provided with a penetrating hole penetrating from front to back, and the fixed plate is fixed to the fixed seat hermetically, the outer end opening of the water passage communicates with the mounting cavity, and the inner end opening is communicates with the penetrating hole;

the outlet waterway of the movable plate is a groove arranged at the back, the back side of the movable plate is relied on the front side of the fixed plate hermetically, the groove is provided with a communicating part and a switch part, and the communicating part always communicates with the penetrating hole, at least one water division hole can be chosen to communicate with the switch part.

12. Rocker switch shower according to claim 11, wherein, two water division holes are arranged eccentrically and provided with the same distance to the rotary shaft of the movable plate;

the farther is the switch part of the groove to the rotary shaft of the movable plate, and the bigger is the central angle.

13. Rocker switch shower according to claim 11, wherein, the operation part also comprises a first gear and a second gear, the first gear is fixed to the inner end of the control shaft, the second gear is connected to the movable plate in a rotating manner synchronously and coaxially, and the first gear is meshed with the second gear.

14. Rocker switch shower according to claim 13, wherein, the first gear is meshed with the second gear, and then a bevel gears mechanism is generated with vertical transmission.

15. Rocker switch shower according to claim 13, wherein, a locating mechanism is arranged between the top end of the second gear and the mounting cavity, which comprises a locating pin, a spring connecting the locating pin with the second gear and a plurality of locating slots opened in the mounting cavity, and the locating pin is coupling with the locating slots.

16. Rocker switch shower according to claim 13, wherein, the operation part also comprises a gear support which is arranged in the mounting cavity in a sliding manner, and the second gear can be connected to the gear support in a rotating manner.

17. Rocker switch shower according to claim 14, wherein, the first gear can be provided with teeth around the periphery of a lower part only, and an upper part is a cambered surface.

* * * * *